US008191984B2

(12) United States Patent
Yamada

(10) Patent No.: US 8,191,984 B2
(45) Date of Patent: Jun. 5, 2012

(54) RECORDING MEDIUM DETECTION METHOD AND LABEL PRINTER

(75) Inventor: Masahiko Yamada, Omi-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/220,276

(22) Filed: Aug. 29, 2011

(65) Prior Publication Data

US 2011/0311292 A1 Dec. 22, 2011

Related U.S. Application Data

(63) Continuation of application No. 12/287,570, filed on Oct. 10, 2008, now Pat. No. 8,029,083.

(30) Foreign Application Priority Data

Oct. 22, 2007 (JP) ..... 2007-273471

(51) Int. Cl.
*B41J 29/38* (2006.01)

(52) U.S. Cl. ..... 347/16; 347/37; 347/101; 347/104; 347/105; 347/106

(58) Field of Classification Search ..... 347/16, 347/37, 101, 104–107
See application file for complete search history.

(56) References Cited

U.S. PATENT DOCUMENTS 6,172,688 B1 * 1/2001 Iwasaki et al. ..... 347/2
2009/0102878 A1 * 4/2009 Yamada ..... 347/16

FOREIGN PATENT DOCUMENTS

JP 07-097133 A 4/1995
JP 2000-071548 A 3/2000
JP 2007-090766 A 4/2007
JP 2007-106556 A 4/2007

OTHER PUBLICATIONS

Notice of Allowance issued in Chinese Application No. 200810170069.3 dated Dec. 20, 2010.

* cited by examiner

*Primary Examiner* — Ryan Lepisto
*Assistant Examiner* — Guy Anderson
(74) *Attorney, Agent, or Firm* — Nutter McClennen & Fish LLP; John J. Penny, Jr.; Derek P. Roller

(57) ABSTRACT

A recording medium detection method uses transmission and reflection photosensors to correctly detect if a recording medium having labels affixed to a liner is in the transportation path. The label printer has a reflection photosensor and a transmission photosensor disposed to the transportation path at positions separated the distance between the labels. Labels on the recording medium can always be detected by either or both the reflection photosensor and the transmission photosensor. Because the reflection photosensor is downstream from the transmission photosensor, a situation in which a black mark is at the detection position of the reflection photosensor and reflection is not detected and only the liner is at the detection position of the transmission photosensor and transmission of the detection beam is detected is avoided. Detecting transmission without detecting reflection of the detection beam therefore only occurs when the recording medium is not in the transportation path.

4 Claims, 6 Drawing Sheets

FIG. 6A

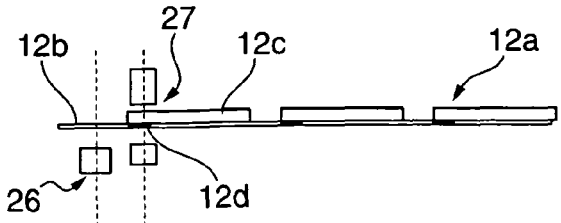

| | IF LINER IS TRANSPARENT | |
|---|---|---|
| | DETECT REFLECTION | DO NOT DETECT REFLECTION |
| | DO NOT DETECT TRANSMISSION | DO NOT DETECT TRANSMISSION |

FIG. 6B

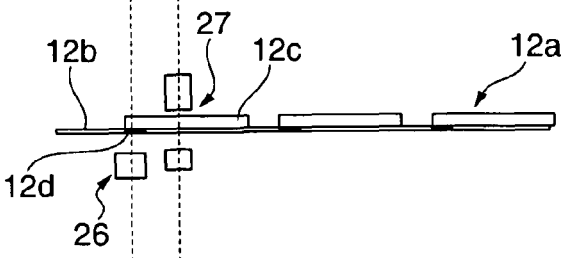

| | IF LINER IS TRANSPARENT | |
|---|---|---|
| | DO NOT DETECT REFLECTION | DO NOT DETECT REFLECTION |
| | DO NOT DETECT TRANSMISSION | DO NOT DETECT TRANSMISSION |

FIG. 6C

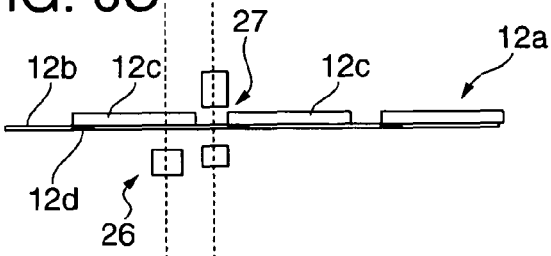

| | IF LINER IS TRANSPARENT | |
|---|---|---|
| | DETECT REFLECTION | DETECT REFLECTION |
| | DETECT TRANSMISSION | DETECT TRANSMISSION |

FIG. 6D

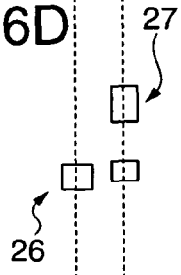

| |
|---|
| DO NOT DETECT REFLECTION |
| DETECT TRANSMISSION |

FIG. 6E

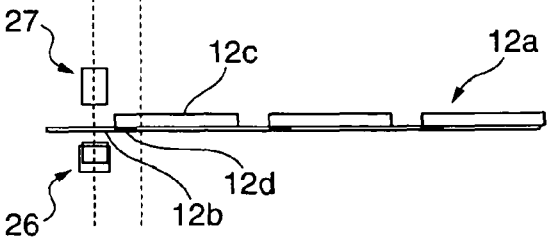

| | IF LINER IS TRANSPARENT | |
|---|---|---|
| | DETECT REFLECTION | DO NOT DETECT REFLECTION |
| | DETECT TRANSMISSION | DETECT TRANSMISSION |

RECORDING MEDIUM DETECTION METHOD AND LABEL PRINTER

Priority is claimed under 35 U.S.C. §119 to Japanese Application No. 2007-273471 filed on Oct. 22, 2007, and under 35 U.S.C. §120 to U.S. application Ser. No. 12/287,570 filed on Oct. 10, 2008, which are hereby incorporated by reference in their entirety.

BACKGROUND OF THE INVENTION

1. Field of Invention

The present invention relates to a recording medium detection method for detecting if a recording medium having peelable labels affixed at a regular interval on the surface of a continuous liner is present in the transportation path of a label printer, for example. More particularly, the invention relates to a recording medium detection method and a label printer that can accurately determine if the recording medium is present or not using a reflection photosensor and a transmission photosensor.

2. Description of Related Art

Label printers convey a recording medium having peelable labels affixed at a regular interval on the surface of a continuous liner passed the printing position of a print head to print the individual labels. A reflection photosensor or a transmission photosensor for detecting the labels is disposed to the transportation path upstream from the printing position in the transportation direction in order to enable printing the labels correctly.

A reflection photosensor detects black marks that are preprinted at regular intervals on the liner to indicate the position of each label. These black marks are printed near the edge of the liner on the downstream side of each label in the transportation direction. When a black mark is at the detection position of the photosensor, the reflection is not detected. If a part of the liner where a black mark is not printed is at the detection position, the reflection is detected.

A transmission photosensor detects each label. If a label is at the detection position of the transmission photosensor, light transmission is not detected. If only the liner between adjacent labels is at the detection position, light transmission is detected.

Japanese Unexamined Patent Appl. Pub. JP-A-2000-71548 teaches a label printer that has both reflection and transmission photosensors. The photoreceptor or photoemitter of the reflection photosensor or transmission photosensor is mounted on one sensor circuit board, and the detection position of the opposing reflection photosensor or transmission photosensor is disposed to the same location in the transportation direction.

With the detection method taught in JP-A-2000-71548, the reflection photosensor will not detect reflected light and the transmission photosensor will not detect the emitted light if there is no recording medium in the transportation path. Some recording media, however, have a transparent liner or have holes or perforations in the liner. If only the liner part of such a recording medium is at the detection position of the reflection photosensor and the transmission photosensor, reflection will not be detected but transmission will be detected, and the photosensor output will be the same as when there is no recording medium in the transportation path. As a result, it will be incorrectly detected that the recording medium is not present even though the recording medium is in the transportation path, and printing will not proceed.

To avoid such detection errors, the label printer could execute the operation that conveys the recording medium a predetermined distance before printing starts, and determine that there is no recording medium in the transportation path if reflection is not detected and there is no change in the transmission detection status during this transportation operation. However, if this method of executing the operation that conveys the recording medium before printing starts to determine if the recording medium is in the transportation path is used, the startup time of the label printer takes longer and usability drops.

SUMMARY OF THE INVENTION

A recording medium detection method according to the present invention enables determining if recording media is in the transportation path without conveying the recording medium, and a label printer according to the present invention uses this detection method to detect if the recording medium is present.

A first aspect of the invention is a recording medium detection method that detects whether or not a recording medium having peelable labels affixed at a regular interval on the surface of a continuous liner is present on a transportation path, including steps of: defining a first position and a second position on the upstream side of this first position as recording medium detection positions in the transportation path; setting the gap in the recording medium transportation direction between the first position and the second position in a range greater than or equal to the length of the interval (gap) between the labels on the recording medium and less than or equal to the length of the labels in the recording medium transportation direction; detecting reflection of a detection beam emitted to the transportation path from one side to the same side at the first position in the transportation path; detecting transmission of a detection beam emitted to the transportation path from one side to the other side at the second position in the transportation path; and determining that the recording medium is not in the transportation path if the reflection is not detected and the transmission is detected. Detecting the reflection and detecting the transmission may occur simultaneously or one before the other.

Because the distance between the reflection photosensor and transmission photosensor is in the range greater than or equal to the length of the gap between the labels on the recording medium and less than or equal to the length of the labels in the recording medium transportation direction, labels on the recording medium can be detected by at least one of the reflection photosensor and transmission photosensor. As a result, when the recording medium is in the transportation path, the detector output will always include either or both that the reflection was detected or transmission was not detected. Furthermore, because the reflection photosensor is disposed to the transportation path on the downstream side of the transmission photosensor, a situation in which a black mark is at the detection position of the reflection photosensor and reflection is not detected, and only the liner is at the detection position of the transmission photosensor and transmission is detected, can be prevented.

As a result, even if the liner is transparent, there is a hole in the liner, or the recording medium has black marks printed to indicate the position of each label, it can be determined that the recording medium is not in the transportation path if reflection is not detected and transmission is detected. The presence of the recording medium in the transportation path can therefore be determined without executing the operation to convey the recording medium before printing starts.

Preferably, the first position and the second position are disposed to the transportation path on the upstream side of the printing position in order to detect if the recording medium is at the printing position.

Further preferably, the first position and the second position are located at separate positions in a direction perpendicular to the recording medium transportation direction in order to avoid detection errors caused by the detection beam output from the reflection photosensor toward the transportation path straying into the transmission photosensor, or the detection beam output from the transmission photosensor toward the transportation path A straying into the reflection photosensor.

Another aspect of the invention is a label printer that has a print head; a transportation path for conveying a recording medium having a continuous liner and peelable labels affixed at a regular interval on the surface of the liner; a reflection photosensor for detecting reflection of a detection beam emitted from one side of the transportation path to the same side; a transmission photosensor for detecting transmission of a detection beam emitted to the transportation path from one side to the other side; and a decision means (unit) for determining the presence of the recording medium in the transportation path based on the detector output from the reflection photosensor and transmission photosensor. The print head, the reflection photosensor, and the transmission photosensor are disposed in this order from the downstream side to the upstream side in the recording medium transportation direction; and the gap in the recording medium transportation direction between the detection position of the reflection photosensor and the detection position of the transmission photosensor is in a range greater than or equal to the length of the gap between the labels on the recording medium and less than or equal to the length of the labels in the recording medium transportation direction.

Preferably, the decision means determines that the recording medium is not in the transportation path if the reflection is not detected and the transmission is detected.

Further preferably, the reflection photosensor and the transmission photosensor are located at separate positions in a direction perpendicular to the recording medium transportation direction.

Further preferably, the invention is used in an inkjet label printer. If printing proceeds when recording medium is not loaded in an inkjet label printer, the ink droplets will adhere to the platen and other parts, thus soiling those parts and requiring time for cleaning. It is therefore necessary to reliably determine if the recording medium is present before starting to print. By using the present invention, whether or not recording medium is in the transportation path can be reliably determined without conveying the recording medium, and the startup time of the inkjet label printer can therefore be shortened.

Because labels on the recording medium can be detected by at least one of the reflection photosensor and transmission photosensor, the detector output will always include either or both that the reflection was detected or transmission was not detected when the recording medium is in the transportation path. A situation in which a black mark is at the detection position of the reflection photosensor and reflection is not detected, and only the liner is at the detection position of the transmission photosensor and transmission is detected, can be prevented.

As a result, it can be determined that the recording medium is not in the transportation path when reflection is not detected and transmission is detected. The presence of the recording medium in the transportation path can therefore be determined without executing the operation to convey the recording medium before printing starts.

Other objects and attainments together with a fuller understanding of the invention will become apparent and appreciated by referring to the following description and claims taken in conjunction with the accompanying drawings.

BRIEF DESCRIPTION OF THE DRAWINGS

FIGS. 6A-6E describe the output levels of the reflection photosensor and transmission photosensor.

DESCRIPTION OF PREFERRED EMBODIMENTS

A label printer according to a preferred embodiment of the Present invention is described below with reference to the accompanying figures.

Figure 1:
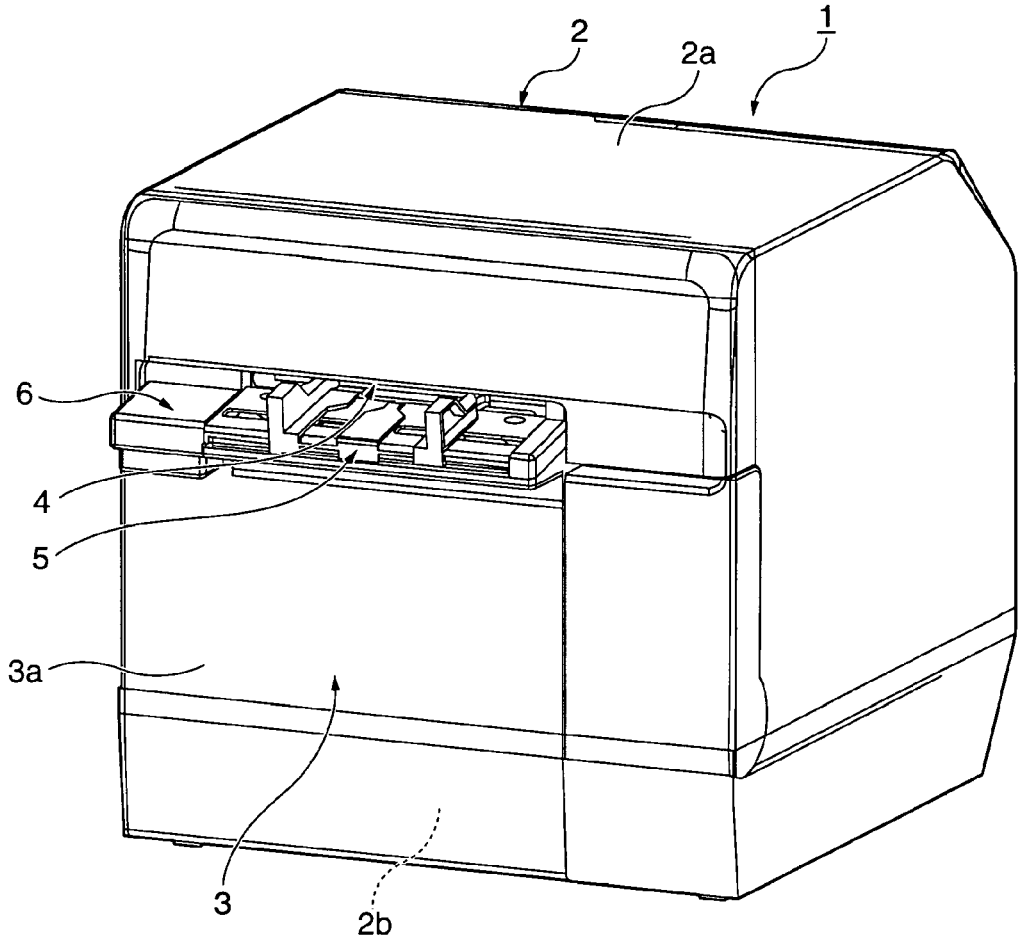
FIG. 1 is an external oblique view of a label printer according to a preferred embodiment of the invention.
Figure 2:
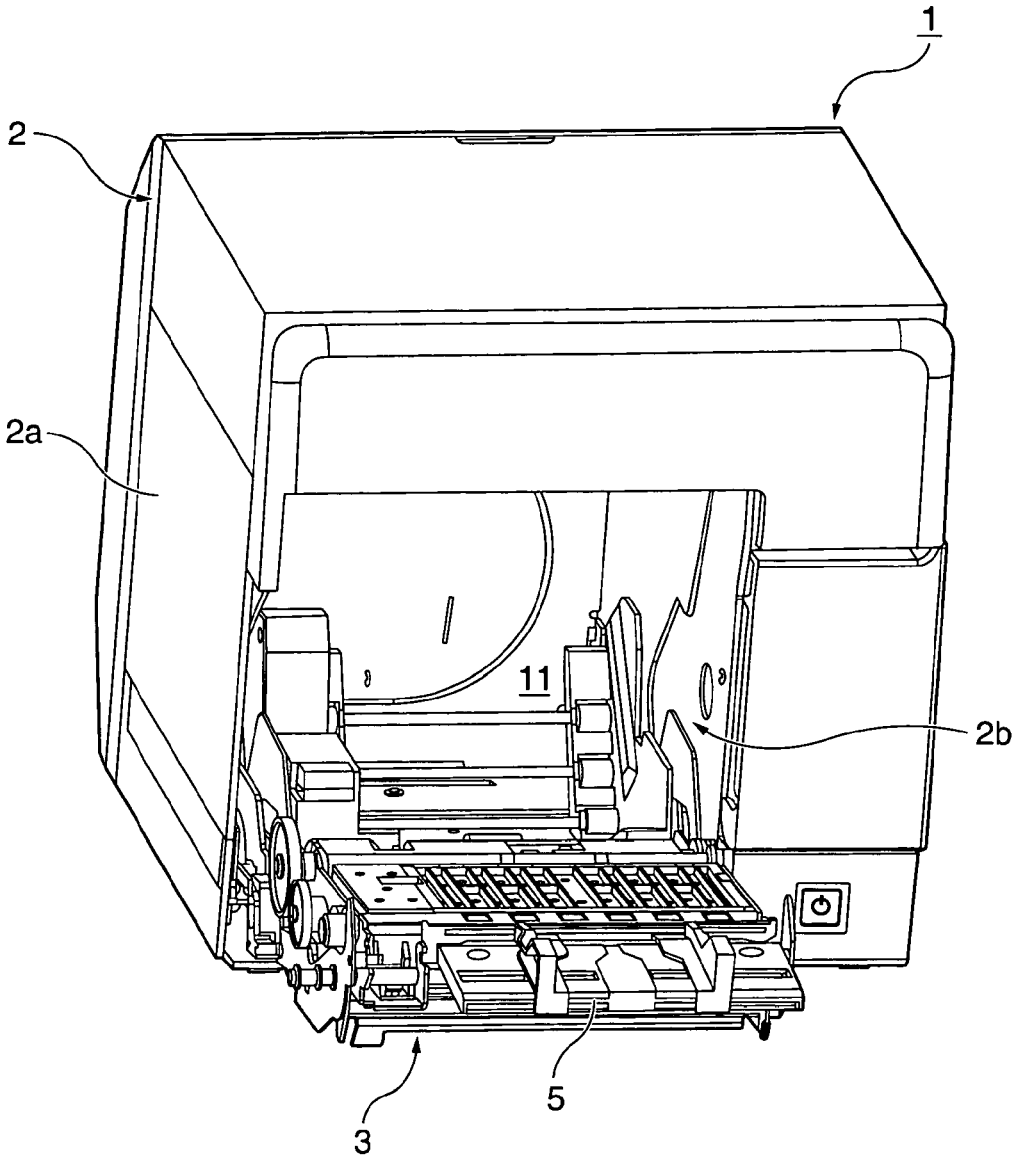
FIG. 2 is an external oblique view of the label printer with the cover unit open.

FIG. 1 is an oblique view showing an inkjet label printer according to a first embodiment of the invention. FIG. 2 is an oblique view of the same printer with the cover open.

The label printer 1 has a rectangular box-like case 2 and a cover 3 that opens and closes and is disposed to the front of the case 2. A paper exit 4 of a specific width is formed at the front of the outside case 2*a* part of the printer case 2. An exit guide 5 projects to the front from the bottom of the paper exit 4, and a cover opening lever 6 is disposed beside the exit guide 5. A rectangular opening 2*b* for loading and removing roll paper is formed in the outside case 2*a* below the exit guide 5 and cover opening lever 6, and this opening 2*b* is closed by the cover 3.

Operating the cover opening lever 6 unlocks the cover 3. When the exit guide 5 is pulled forward, the cover 3 pivots at the bottom end part thereof and opens forward to a substantially horizontal position as shown in FIG. 2. When the cover 3 opens, the roll paper compartment 11 formed inside the printer opens. The transportation path A from the roll paper compartment 11 to the paper exit 4 also opens simultaneously (see FIG. 3), and the roll paper can be easily replaced from the front of the printer. Note that the outside part of the cover 3 and the cover opening lever 6 are not shown in FIG. 2.

Figure 3:
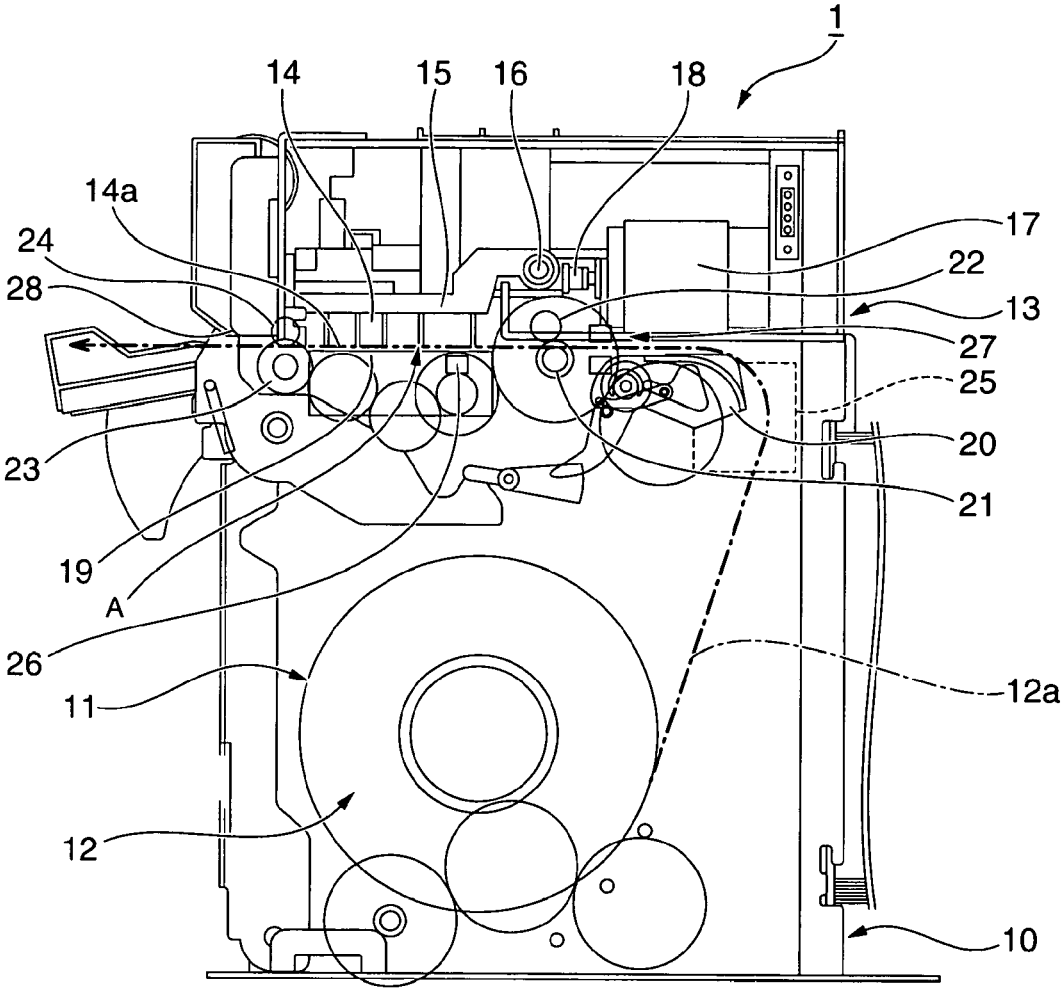
FIG. 3 is a vertical section view showing the internal structure of the label printer.

FIG. 3 shows the internal configuration of the label printer.

A roll paper compartment 11 is formed inside the label printer 1 in the center between the sides of the printer frame 10. Roll paper 12 is stored horizontally widthwise to the printer inside the roll paper compartment 11.

A head unit frame 13 is disposed horizontally at the top of the printer frame 10 above the roll paper compartment 11. Disposed to the head unit frame 13 are an inkjet head 14, a carriage 15 that carries the inkjet head 14, and a carriage guide shaft 16 that guides movement of the carriage 15 widthwise to the printer. A carriage drive mechanism including a carriage motor 17 and timing belt 18 for conveying the carriage 15 bidirectionally along the carriage guide shaft 16 are also disposed to the head unit frame 13.

The inkjet head 14 is mounted on the carriage 15 with the ink nozzle surface 14*a* facing down. The carriage guide shaft 16 is disposed horizontally between the sides of the printer.

A platen 19 is disposed horizontally widthwise to the printer below the inkjet head 14 with a constant gap therebetween. The platen 19 determines the printing position of the inkjet head 14.

A tension guide 20 that curves downward is attached on the back side of the platen 19. The recording medium 12*a* is pulled from the roll paper 12 stored in the roll paper compartment 11 and travels through the transportation path A passed the printing position with predetermined tension applied to the recording medium 12*a* by the tension guide 20.

The recording medium 12*a* has a continuous liner 12*b*, peelable labels 12*c* that are affixed to the surface of the liner 121D at a constant interval, and black marks 12*d* that are preprinted at a constant interval on the back of the liner 12*b* in order to indicate the position of each label 12*c*. See FIGS. 5A and 5B.

A rear paper feed roller 21 is also disposed horizontally on the back side of the platen 19 widthwise to the printer. A rear paper pressure roller 22 of a predetermined width is pressed with predetermined force to the rear paper feed roller 21 with the recording medium 12*a* therebetween.

A front paper feed roller 23 is disposed to a position on the front side of the platen 19. A front paper pressure roller 24 is pressed to the front paper feed roller 23 from above with the recording medium 12*a* therebetween.

The rear paper feed roller 21 and front paper feed roller 23 are driven by a paper transportation motor 25 mounted on the printer frame 10.

A reflection photosensor 26 is disposed below the transportation path A between the inkjet head 14 and the rear paper feed roller 21. The reflection photosensor 26 has a photoemitter and a photoreceptor, and detects black marks 12*d* on the recording medium 12*a* by detecting the downward reflection of the detection beam emitted toward the transportation path A from below.

A transmission photosensor 27 is disposed to the transportation path A upstream from the reflection photosensor 26 between the rear paper feed roller 21 and the tension guide 20. The transmission photosensor 27 has a photoemitter disposed above and a photoreceptor disposed below the transportation path A so that the transportation path is therebetween, and detects the presence of a label 12*c* on the recording medium 12*a* by detecting transmission of the detection beam emitted toward the transportation path A from above at a position below the transportation path A. Note that the photoemitter and the photoreceptor of the transmission photosensor 27 are disposed on opposite sides of the transportation path, and may be reversed from the orientation described here.

A scissors-type paper cutter 28 may also be disposed to the paper exit 4. The paper cutter 28 cuts across the width of the recording medium 12*a* positioned therein.

Control System

Figure 4:
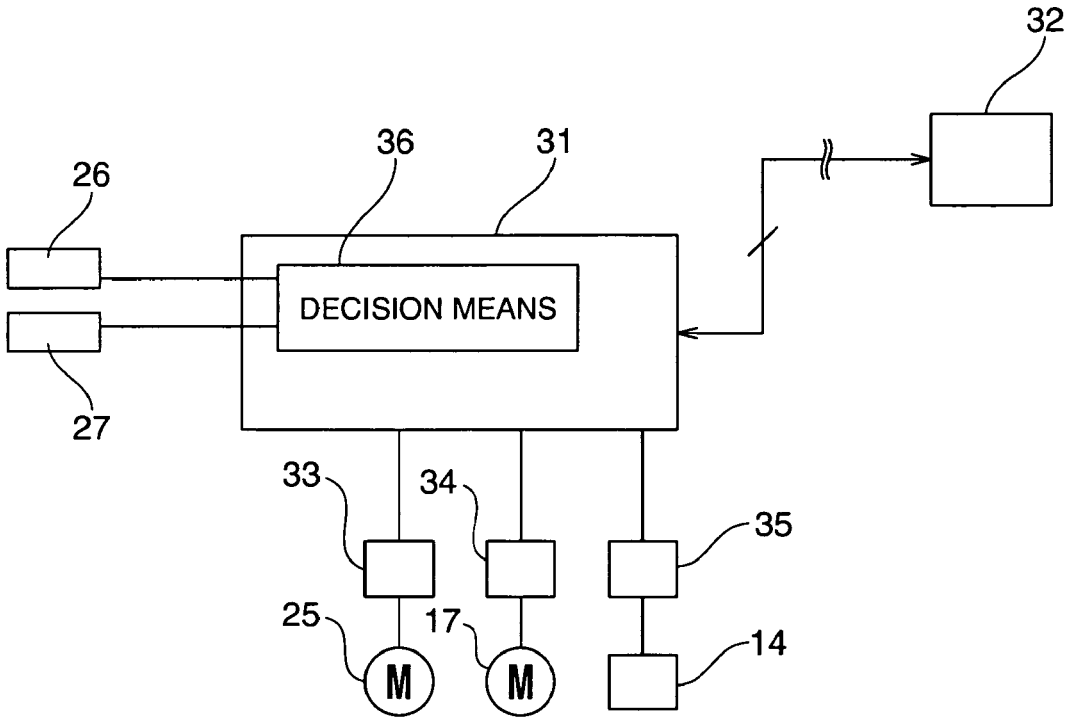
FIG. 4 is a schematic block diagram showing the control system of the label printer.

FIG. 4 is a schematic block diagram showing the control system of the label printer 1. The control system is built around a drive control unit 31 that has a microprocessor. The drive control unit 31 receives print commands and print data supplied from a host computer or other host device 32, and executes the paper transportation operation and printing operation. Detector output indicating the position of a label 12*c* on the recording medium 12*a* is input from the reflection photosensor 26 and transmission photosensor 27 to the drive control unit 31. Based on this detector output, the drive control unit 31 controls driving the paper transportation motor 25 and carriage motor 17 by intervening motor drivers 33 and 34. The drive control unit 31 also controls driving the inkjet head 14 through a head driver 35.

The drive control unit 31 has a decision means 36 that evaluates the presence of recording medium 12*a* in the transportation path A based on detector output received from the transmission photosensor 27 and reflection photosensor 26 when print commands and print data are received from the host device 32.

If the decision means 36 determines that recording medium 12*a* is in the transportation path A, the paper feed operation executes and the recording medium 12*a* is conveyed to a predetermined printing start position. The carriage 15 is then driven bidirectionally along the carriage guide shaft 16 while the inkjet head 14 mounted thereon prints on the surface of the recording medium 12*a* delivered from the roll paper 12 and located at the printing position. After the line printing operation is completed across the width of the recording medium 12*a*, the rear paper feed roller 21 and front paper feed roller 23 are driven rotationally to advance the recording medium 12*a* a predetermined pitch. The next line is then printed.

The recording medium 12*a* is thus printed by the inkjet head 14 while being intermittently advanced a predetermined pitch. When printing is completed the recording medium 12*a* is cut by the paper cutter 28 located at the paper exit 4.

Figure 5A:
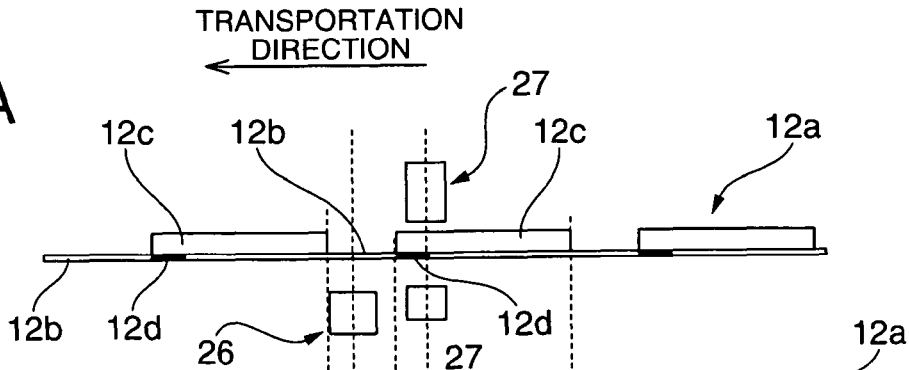
FIGS. 5A and 5B are a side view and a plan view showing the positions of the reflection photosensor and the transmission photosensor.
Figure 5B:
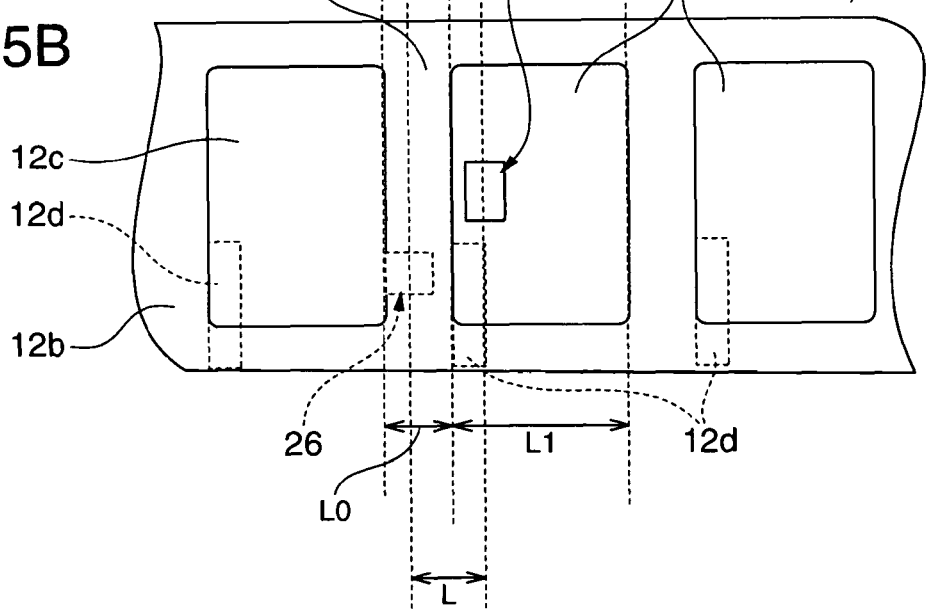

Installation Positions of the Reflection Photosensor and Transmission Photosensor FIG. 5A is a side view and FIG. 5B is a plan view describing the positions of the recording medium 12*a*, reflection photosensor 26, and transmission photosensor 27 in the transportation path A.

As shown in FIGS. 5A and 5B, the reflection photosensor 26 and transmission photosensor 27 are disposed in this order from the downstream side to the upstream side of the transportation direction. The gap L between the transmission photosensor 27 and reflection photosensor 26 is slightly greater than the distance L0 between the labels 12*c* on the recording medium 12*a*. The gap L between the reflection photosensor 26 and transmission photosensor 27 is greater than or equal to the gap L0 between the labels 12*c* and less than or equal to the length L1 of the labels 12*c* in the transportation direction.

The reflection photosensor 26 and transmission photosensor 27 are separated from each other perpendicularly to the transportation direction to avoid mutual interference caused by their detection beams.

The black marks 12*d* on the recording medium 12*a* are printed at the edge on the back of the liner 12*b* on the downstream side of each label 12*c* in the transportation direction.

Evaluating the Presence of Recording Medium

The method whereby the decision means 36 determines the presence of the recording medium 12*a* in the transportation path A based on output from the transmission photosensor 27 and reflection photosensor 26 is described next with reference to FIGS. 6A-6E. FIGS. 6A-6E show the output of the reflection photosensor 26 and transmission photosensor 27. FIG. 6A to FIG. 6C show the output when the recording medium 12*a* is in the transportation path A, FIG. 6D shows the output when the recording medium 12*a* is not in the transportation path A, and FIG. 6E shows the output when the reflection photosensor 26 and transmission photosensor 27 are located at the same position in the transportation direction for comparison.

When the liner 12*b* is at the detection position of the reflection photosensor 26 as shown in FIG. 6A, the reflection is detected by the reflection photosensor 26. Because a label 12*c* is at the detection position of the transmission photosensor 27 in this example, transmission of the detection beam will not be detected by the transmission photosensor 27.

If in this situation the liner 12*b* is transparent or there is a hole or opening in the liner 12*b*, the detection beam emitted from the reflection photosensor 26 toward the recording medium 12*a* will not be reflected and the reflection photosensor 26 therefore cannot detect the reflection as indicated in the right column in FIG. 6A.

When a black mark 12*d* is at the detection position of the reflection photosensor 26 as shown in FIG. 6B, the reflection photosensor 26 does not detect the reflection. Furthermore, because a label 12*c* is at the detection position of the transmission photosensor 27, the transmission photosensor 27 does not detect light transmission.

In this situation there is a label 12*c* at the detection position of the reflection photosensor 26 and at the detection position of the transmission photosensor 27. Therefore, even if the liner 12*b* is transparent or there is a hole or opening in the liner 12*b*, the reflection photosensor 26 does not detect reflection and the transmission photosensor 27 does not detect transmission as indicated in the right column in FIG. 6B.

In the situation shown in FIG. 6C the reflection photosensor 26 detects a reflection because the liner 12*b* is at the detection position of the reflection photosensor 26. In addition, because only the liner 12*b* part of the recording medium 12*a* is at the detection position of the transmission photosensor 27, the transmission photosensor 27 also detects transmission.

If in this situation the liner 12*b* is transparent or there is a hole or opening in the liner 12*b*, there is nothing to block the detection beam emitted from the transmission photosensor 27 toward the recording medium 12*a*. The transmission photosensor 27 therefore detects the transmission, but detector output is the same as when the liner 12*b* is not transparent.

However, if the recording medium 12*a* is not in the transportation path A, the reflection photosensor 26 will not detect a reflection because there is nothing to reflect the detection beam emitted from the reflection photosensor 26 toward the transportation path A as shown in FIG. 6D. In addition, the transmission photosensor 27 detects the transmitted light because there is nothing to block the detection beam emitted from the transmission photosensor 27 toward the recording medium 12*a*.

As described above, transmission is detected and reflection is not detected only when the recording medium 12*a* is not in the transportation path A. The decision means 36 can therefore determine if the recording medium 12*a* is in the transportation path A based on the detection results from the transmission photosensor 27 and reflection photosensor 26.

In the situation shown for comparison in FIG. 6E, the detection position of the reflection photosensor 26 and the detection position of the transmission photosensor 27 are at the same position in the transportation direction, and only the liner 12*b* is at this detection position. The reflection photosensor 26 therefore detects the reflection and the transmission photosensor 27 detects transmission.

However, if the liner 12*b* is transparent or there is a hole or opening in the liner 12*b*, the reflection photosensor 26 will not detect a reflection because there is nothing to reflect the detection beam emitted from the reflection photosensor 26 toward the transportation path A as shown in the right column in FIG. 6E. In addition, the transmission photosensor 27 detects the transmitted light because there is nothing to block the detection beam emitted from the transmission photosensor 27 toward the recording medium 12*a*. The detector output of the reflection photosensor 26 and transmission photosensor 27 is thus the same as when the recording medium 12*a* is not in the transportation path A, and whether or not the recording medium is in the transportation path cannot be determined without executing the operation to convey the recording medium 12*a* a predetermined distance while confirming if there is a change in the status of transmission being detected and reflection not being detected during this transportation operation.

As described above, a label printer according to this embodiment of the invention has a reflection photosensor 26 and a transmission photosensor 27 disposed to the transportation path A at locations separated in the transportation direction of the recording medium 12*a*. The distance L between the photosensors is slightly greater than the gap between the labels 12*c* on the recording medium 12*a*. Either the reflection photosensor 26 or the transmission photosensor 27 can therefore always detect the label 12*c* part of the recording medium 12*a*. As a result, if the recording medium 12*a* is in the transportation path A, the detector output will always include either or both that reflection is detected or that transmission is not detected.

Furthermore, because the reflection photosensor 26 is downstream from the transmission photosensor 27, a situation in which a black mark 12*d* is at the detection position of the reflection photosensor 26 and reflection is not detected, and only the liner 12*b* is at the detection position of the transmission photosensor 27 and transmission is detected, can be prevented.

As a result, reflected light will not be detected even if the liner 12*b* is transparent, if there is a hole in the liner 12*b*, or if the recording medium 12*a* has black marks 12*d* printed to indicate the position of each label 12*c*. Furthermore, if transmission is detected, it can be determined that there is no recording medium 12*a* in the transportation path A. The presence of recording medium 12*a* in the transportation path can therefore be determined without executing the operation to convey the recording medium 12*a* before printing starts.

Furthermore, because the reflection photosensor 26 and transmission photosensor 27 are located at separated positions perpendicularly to the transportation direction, detection errors caused by the detection beam output from the reflection photosensor 26 toward the transportation path A straying into the transmission photosensor 27, or the detection beam output from the transmission photosensor 27 toward the transportation path A straying into the reflection photosensor 26, can be prevented.

Other Embodiments of the Invention

The invention can also be applied in thermal printers and types of printers other than inkjet label printers.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A recording medium detection method that detects whether or not a recording medium having peelable labels affixed at a regular interval on a surface of a continuous liner is present on a transportation path, comprising steps of:

defining a first position and a second position on the upstream side of the first position as recording medium detection positions in the transportation path;

setting a gap in the recording medium transportation direction between the first position and the second position in a range greater than or equal to the length of the gap between the labels on the recording medium and less than or equal to the length of the labels in the recording medium transportation direction;

detecting reflection of a detection beam emitted to the transportation path from one side to a same side at the first position in the transportation path;

detecting transmission of a detection beam emitted to the transportation path from one side to another side at the second position in the transportation path.

2. The recording medium detection method described in claim 1, wherein:

the first position and the second position are on the upstream side of the printing position where the recording medium in the transportation path is printed.

3. The recording medium detection method described in claim 1, wherein:

the first position and the second position are located at separate positions in a direction perpendicular to the recording medium transportation direction.

4. The recording medium detection method described in claim 2, wherein:

the first position and the second position are located at separate positions in a direction perpendicular to the recording medium transportation direction.

* * * * *